US010409194B2

(12) United States Patent
Okuno

(10) Patent No.: US 10,409,194 B2
(45) Date of Patent: Sep. 10, 2019

(54) DEVELOPER CONTAINER AND IMAGE FORMING APPARATUS HAVING TRANSPORTING MEMBER WITH AIR PASSAGE PORTIONS

(71) Applicant: FUJI XEROX CO., LTD., Tokyo (JP)

(72) Inventor: Taichiro Okuno, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,995

(22) Filed: Sep. 8, 2017

(65) Prior Publication Data

US 2018/0267429 A1 Sep. 20, 2018

(30) Foreign Application Priority Data

Mar. 16, 2017 (JP) ..... 2017-051596

(51) Int. Cl.

| | |
|---|---|
| ***G03G 15/08*** | (2006.01) |
| *G03G 21/16* | (2006.01) |
| *G03G 15/16* | (2006.01) |
| *G03G 21/20* | (2006.01) |

(52) U.S. Cl.

CPC ..... *G03G 15/0865* (2013.01); *G03G 15/0808* (2013.01); *G03G 15/0877* (2013.01); *G03G 15/0891* (2013.01); *G03G 15/0893* (2013.01); *G03G 15/163* (2013.01); *G03G 21/1647* (2013.01); *G03G 21/206* (2013.01); *G03G 2215/083* (2013.01); *G03G 2221/1657* (2013.01)

(58) Field of Classification Search

CPC ..... G03G 15/0865; G03G 15/0808; G03G 15/163; G03G 15/0877; G03G 2221/1657; G03G 21/1647; G03G 15/0887; G03G 15/0889; G03G 15/0891; G03G 15/0893; G03G 2215/0819; G03G 2215/083; G03G 2215/0838

See application file for complete search history.

(56) References Cited

U.S. PATENT DOCUMENTS

| | | | | |
|---|---|---|---|---|
| 6,560,429 B2 * | 5/2003 | Bares | G03G 15/0822 | 399/253 |
| 2012/0099899 A1 * | 4/2012 | Kuramoto | G03G 15/0822 | 399/254 |
| 2013/0078002 A1 * | 3/2013 | Stelter | G03G 15/0893 | 399/254 |

(Continued)

FOREIGN PATENT DOCUMENTS

| | | | |
|---|---|---|---|
| JP | 2002214892 A | * | 7/2002 |
| JP | 2009109741 A | * | 5/2009 |

(Continued)

*Primary Examiner* — David M. Gray
*Assistant Examiner* — Laura Roth
(74) *Attorney, Agent, or Firm* — Sughrue Mion, PLLC

(57) ABSTRACT

A developer container includes a container, a transporting member, and a passage portion. The container holds a developer. The transporting member includes a shaft, rotatably supported by the container, and a transporting portion that is supported by the shaft and that transports the developer in the container when the shaft rotates. The passage portion is formed in the transporting portion and allows air to pass therethrough in an axial direction of the shaft.

10 Claims, 8 Drawing Sheets

(56) References Cited

U.S. PATENT DOCUMENTS

| | | | | |
|---|---|---|---|---|
| 2015/0139697 | A1* | 5/2015 | Tsukijima ..... | G03G 15/0893<br>399/254 |
| 2016/0139542 | A1* | 5/2016 | Furukawa ..... | G03G 15/0891<br>399/256 |

FOREIGN PATENT DOCUMENTS

| | | | |
|---|---|---|---|
| JP | 2014-235367 | A | 12/2014 |
| JP | 2015-194685 | A | 11/2015 |

* cited by examiner

DEVELOPER CONTAINER AND IMAGE FORMING APPARATUS HAVING TRANSPORTING MEMBER WITH AIR PASSAGE PORTIONS

CROSS-REFERENCE TO RELATED APPLICATIONS

This application is based on and claims priority under 35 USC 119 from Japanese Patent Application No. 2017-051596 filed Mar. 16, 2017.

BACKGROUND

Technical Field

The present invention relates to a developer container and an image forming apparatus.

SUMMARY

According to an aspect of the invention, a developer container includes a container, a transporting member, and a passage portion. The container holds a developer. The transporting member includes a shaft, rotatably supported by the container, and a transporting portion, which is supported by the shaft and transports the developer in the container when the shaft rotates. The passage portion is formed in the transporting portion and allows air to pass therethrough in an axial direction of the shaft.

BRIEF DESCRIPTION OF THE DRAWINGS

Exemplary embodiments of the present invention will be described in detail based on the following figures, wherein:

FIG. 4A is a sectional view of the developing device taken along line IVA-IVA of FIG. 3, and FIG. 4B is a sectional view of the developing device taken along line IVB-IVB of FIG. 3;

DETAILED DESCRIPTION

Specific exemplary embodiments of the present invention (hereinafter referred to as exemplary embodiments) are described with reference to the drawings, now. The present invention, however, is not limited to the following exemplary embodiments.

For ease of understanding the following description, the front-rear direction refers to the x-axis direction, the lateral direction refers to the y-axis direction, and the vertical direction refers to the z-direction throughout the drawings. The directions or sides denoted with arrows X, −X, Y, −Y, Z, and −Z respectively refer to frontward, backward, rightward, leftward, upward, and downward directions or front, back, right, left, top, and bottom sides.

Throughout the drawings, an encircled dot denotes an arrow directing from the back to the front of the sheet, and an encircled cross denotes an arrow directing from the front to the back of the sheet.

For ease of understanding, components other than those used for illustration are appropriately omitted in the following description with reference to the drawings.

First Exemplary Embodiment

Figure 1:
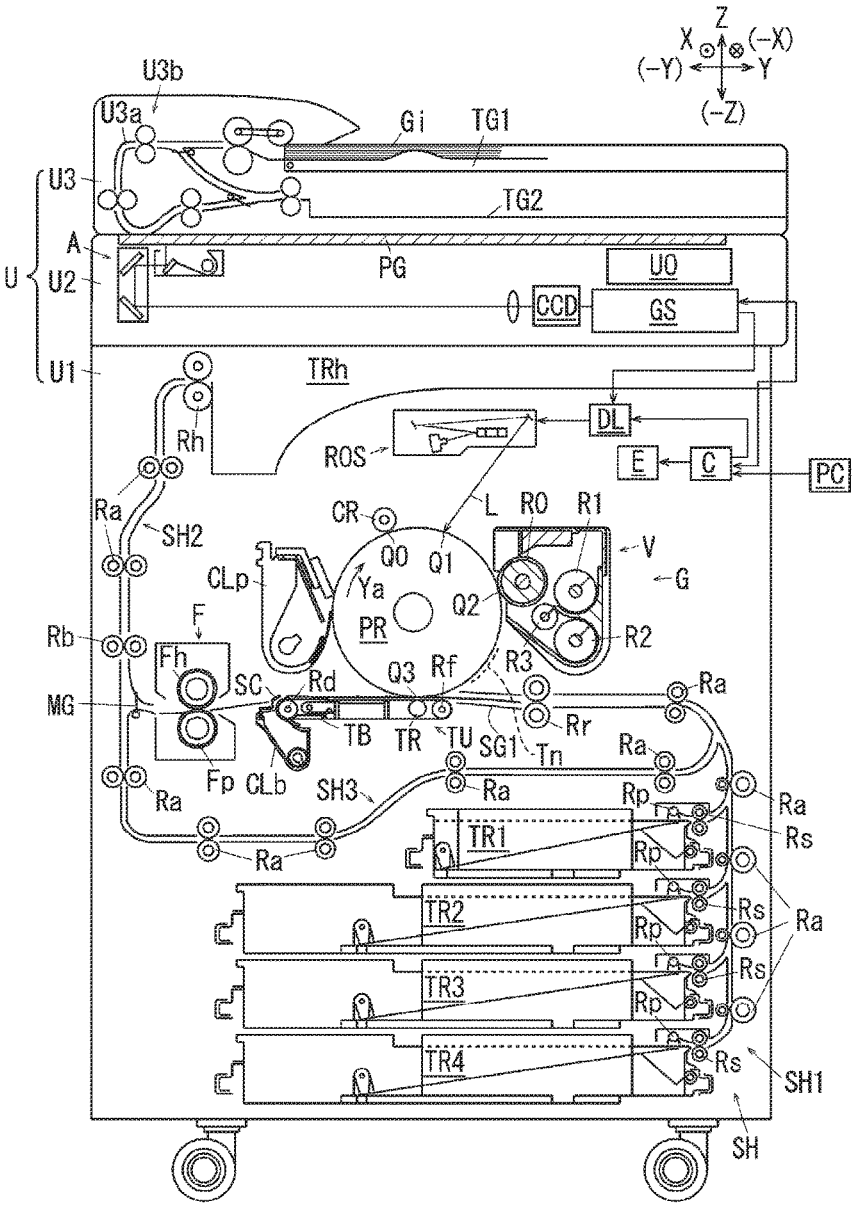
FIG. 1 illustrates an image forming apparatus according to a first exemplary embodiment of the present invention.

FIG. 1 illustrates an image forming apparatus according to a first exemplary embodiment of the present invention.

In FIG. 1, a copying machine U, which is an example of the image forming apparatus according to the first exemplary embodiment includes a printer unit U1, which is an example of a recording unit or an example of an image recording device. A scanner unit U2, which is an example of a reading unit or an example of an image reading device, is supported on top of the printer unit U1. An auto-feeder U3, which is an example of a document transport device, is supported on top of the scanner unit U2. A user interface U0, which is an example of an input portion, is supported on the scanner unit U2 according to the first exemplary embodiment. The user interface U0 allows an operator to perform inputs thereon to operate the copying machine U.

A document tray TG1, which is an example of a container for media, is disposed at an upper portion of the auto-feeder U3. The document tray TG1 is capable of receiving a stack of multiple documents Gi to be copied. A document discharge tray TG2, which is an example of a document discharge portion, is disposed under the document tray TG1. Between the document tray TG1 and the document discharge tray TG2, document transport rollers U3*b* are disposed along a document transport path U3*a*.

A platen glass PG, which is an example of a transparent document table, is disposed at the top surface of the scanner unit U2. The scanner unit U2 according to the first exemplary embodiment includes a reading optical system A, disposed below the platen glass PG. The reading optical system A according to the first exemplary embodiment is supported so as to be movable in the lateral direction along the bottom surface of the platen glass PG. The reading optical system A is normally positioned in an initial position illustrated in FIG. 1.

A charge coupled device CCD, which is an example of an imaging member, is located to the right side of the reading optical system A. An image processor GS is electrically connected to the charge coupled device CCD.

The image processor GS is electrically connected to a writable circuit DL of the printer unit U1. The writable circuit DL is electrically connected to an exposure device ROS, which is an example of a latent-image forming device.

A photoconductor drum PR, which is an example of an image carrier, is disposed in the printer unit U1. A charging roller CR, which is an example of a charging member, a developing device G, a transfer unit TU, which is an example of a transfer device, and a drum cleaner CLp, which is an example of a cleaner, are arranged around the photoconductor drum PR.

Paper feed trays TR1 to TR4, which are an example of medium containers, are disposed below the transfer unit TU. A transport path SH1 extends from the paper feed trays TR1 to TR4. Pick-up rollers Rp, which are an example of a medium pick-up member, separation rollers Rs, which are an example of a separation member, transport rollers Ra, which are an example of a transporting member, and registration rollers Rr, which are an example of a sending member, are disposed on the transport path SH1.

A fixing device F, including a heating roller Fh and a pressing roller Fp, is located to the left of the transfer unit TU. The fixing device F and the discharge tray TRh are connected to each other with a discharging path SH2. The discharging path SH2 and the registration rollers Rr are connected to each other with a reversing path SH3. Transport rollers Rb, rotatable forward and backward, and discharging rollers Rh are disposed on the discharging path SH2.

Description on Image Forming Operation

Multiple documents Gi held in the document tray TG1 sequentially pass a document reading position on the platen glass PG and are discharged to the document discharge tray TG2.

To copy documents that are automatically transported by the auto-feeder U3, the reading optical system A, when positioned in the initial position, exposes, to light, the documents Gi that sequentially pass the reading position on the platen glass PG.

When an operator manually places documents Gi on the platen glass PG to copy the documents Gi, the reading optical system A moves in the lateral direction to scan the documents on the platen glass PG while exposing the documents to light.

Light reflected by the documents Gi passes through the reading optical system A and is condensed to the charge coupled device CCD. The charge coupled device CCD converts the light reflected by the documents and condensed on its imaging surface into electric signals.

The image processor GS converts the read signals input from the charge coupled device CCD into digital image signals and outputs the image signals to the writable circuit DL of the printer unit U1. The writable circuit DL outputs control signals corresponding to the input image signals to the exposure device ROS.

The exposure device ROS emits a laser beam L to form a latent image on the surface of the photoconductor drum PR charged by the charging roller CR. The latent image on the surface of the photoconductor drum PR is developed into a visible image by the developing device G. A transfer roller TR of the transfer unit TU transfers the visible image on the surface of the photoconductor drum PR to a recording sheet, which is an example of a medium, transported along the transport path SH1. The visible image transferred to the recording sheet is fixed to the recording sheet by the fixing device F. When subjected to double-side printing, the recording sheet that has passed through the fixing device F is transported to the reversing path SH3. When discharged to the discharge tray TRh, the recording sheet is discharged by the discharging rollers Rh.

Description on Developing Device

Figure 2:
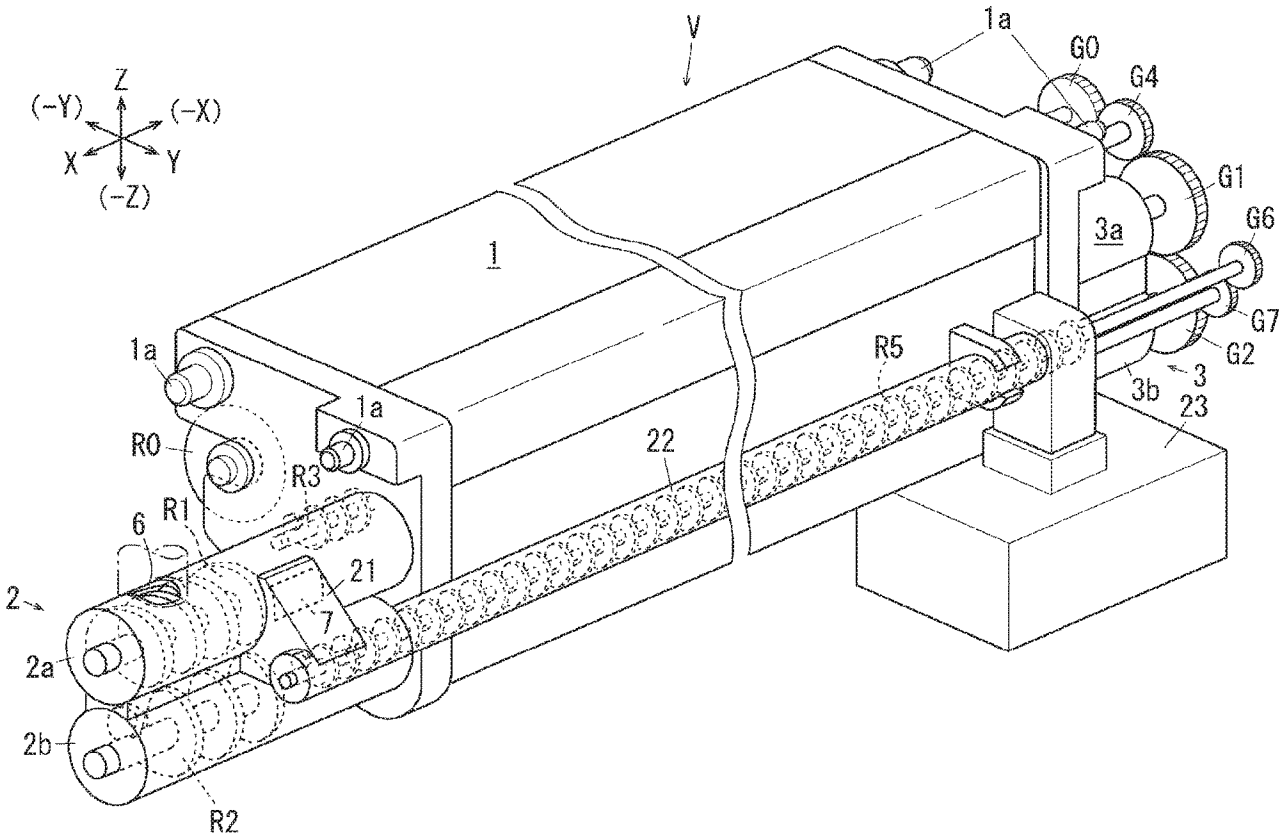
FIG. 2 is a perspective view of a developing device.

FIG. 2 is a perspective view of a developing device.

Figure 3:
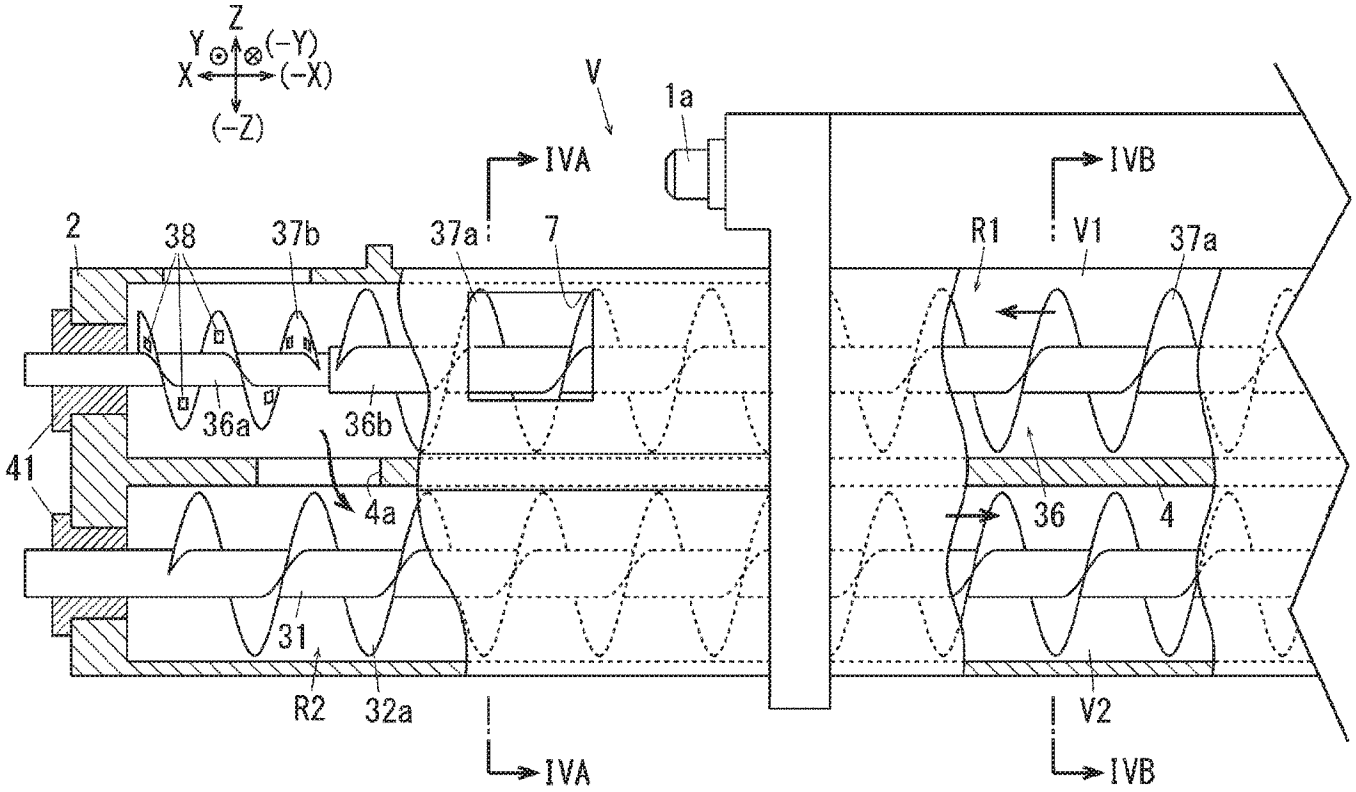
FIG. 3 is a sectional view of a portion of a developer feed port of the developing device.

FIG. 3 is a sectional view of a portion of a developer feed port of the developing device.

Figure 4A:
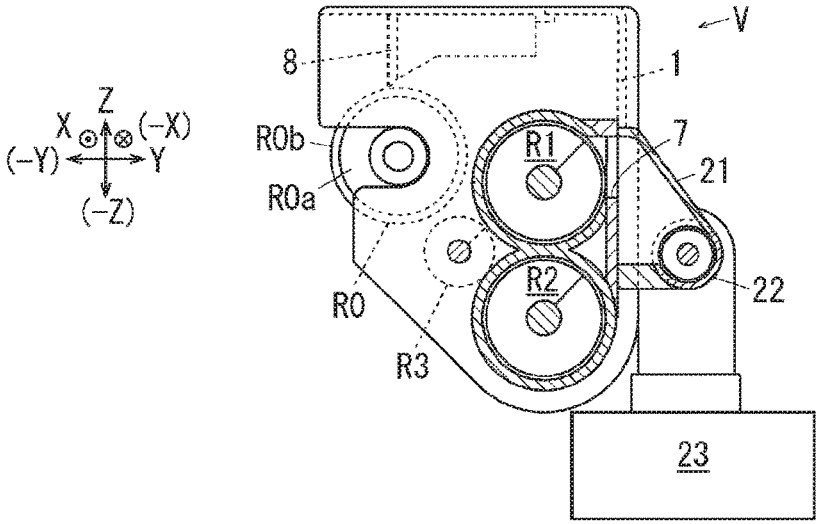
FIGS. 4A and 4B illustrate the developing device according to the first exemplary embodiment, where
Figure 4B:
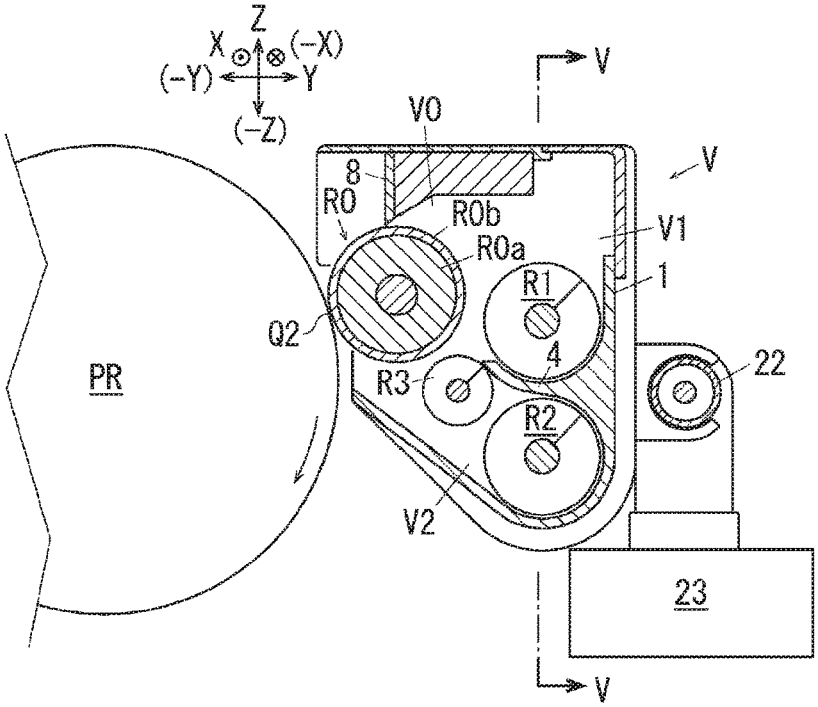

FIGS. 4A and 4B illustrate the developing device according to the first exemplary embodiment, where FIG. 4A is a sectional view of the developing device taken along line IVA-IVA of FIG. 3, and FIG. 4B is a sectional view of the development device taken along line IVB-IVB of FIG. 3.

Figure 5:
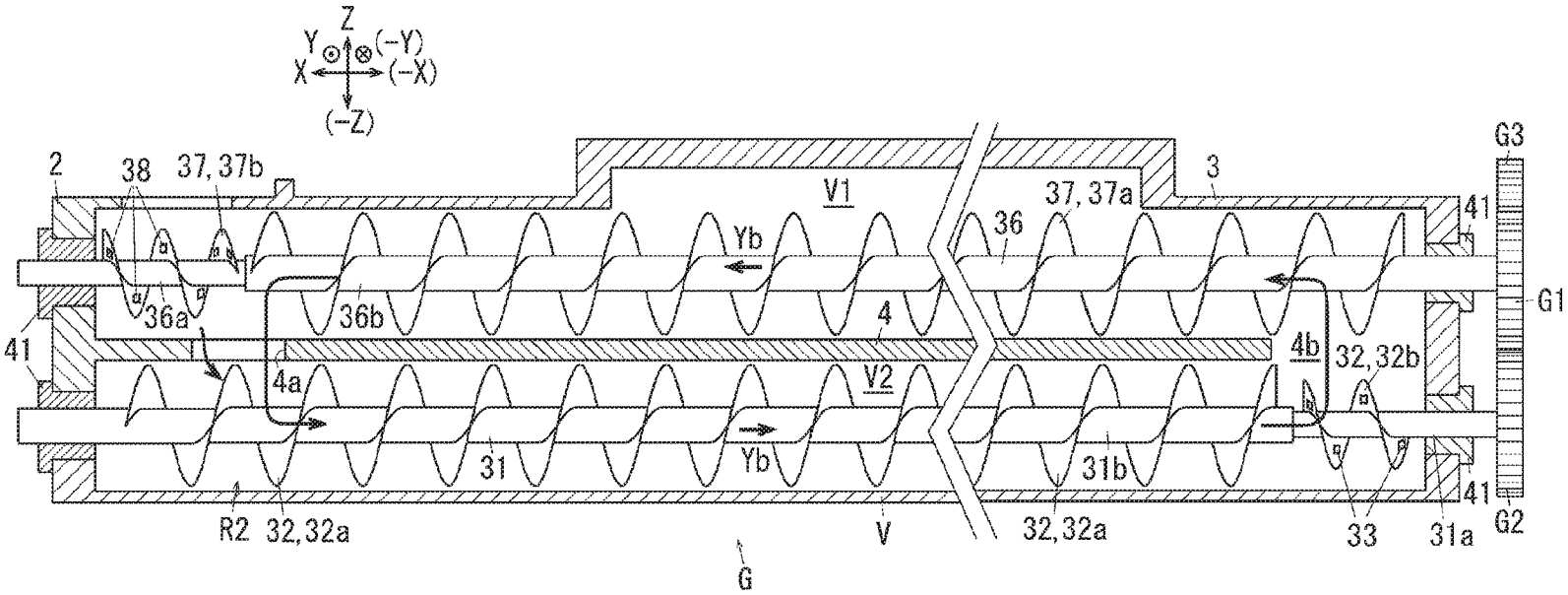
FIG. 5 is a sectional view of the developing device taken along line V-V in FIG. 4B.

FIG. 5 is a sectional view of the development device taken along line V-V of FIG. 4B.

In FIGS. 1 to 4B, the developing device G, which is an example of a developer container, is disposed so as to face the photoconductor drum PR in a development area Q2. In FIGS. 1 to 5, the developing device G includes a developer container V, which is an example of a container. In the first exemplary embodiment, the developer container V holds a two-component developer containing a negatively charged toner and a positively charged magnetic carrier.

In FIG. 2, the developer container V includes a developer container body 1 extending in a front-rear direction. A front connection member 2 is connected to the front end of the developer container body 1. A rear connection member 3 is connected to the rear end of the developer container body 1. The front connection member 2 includes a front upper tube 2*a* and a front lower tube 2*b*. The rear connection member 3 includes a rear upper tube 3*a* and a rear lower tube 3*b*.

In FIG. 2, a pair of supportable portions 1*a* are disposed at upper portions of the developer container body 1 on the front and rear sides. Each supportable portion 1*a* is supported while being positioned in a frame, an example of a frame of the copying machine U when the developer container V is mounted inside the copying machine U. The frame of the copying machine U is not illustrated.

A development roller chamber V0, which is an example of a third container portion, is disposed at an upper left portion of the developer container body 1. A feed chamber V1, which is an example of a first container portion, is located to the right of the development roller chamber V0. An agitation chamber V2, which is an example of a second container portion, is disposed under the feed chamber V1. The feed chamber V1 is disposed in an upper right portion of the developer container body 1 and inside the upper tubes 2*a* and 3*a*. The agitation chamber V2 is disposed in a lower right portion of the developer container body 1 and inside the lower tubes 2*b* and 3*b*.

The development roller chamber V0 is connected to the feed chamber V1 and the agitation chamber V2 throughout the front-rear direction.

A partitioning wall 4 is disposed between the feed chamber V1 and the agitation chamber V2. The partitioning wall 4 divides the inside of the developer container V into upper and lower sides. The partitioning wall 4 has communication ports 4*a* and 4*b*, which are an example of an inlet portion, that connect between the upper and lower sides at front and rear end portions of the partitioning wall 4.

In FIGS. 4A and 4B, a development roller R0 is supported in the development roller chamber V0 at a portion facing the photoconductor drum PR. A feeding auger R1, which is an example of a first transporting member, is disposed in the feed chamber V1. An agitation auger R2, which is an example of a second transporting member, is disposed in the agitation chamber V2. In the developing device G according to the first exemplary embodiment, a stuck-developer transport auger R3, which is an example of a third transporting member, is disposed between the development roller R0 and the agitation auger R2.

The development roller R0 is a known member including a magnet roller R0*a*, which is an example of a magnet member, and a development sleeve R0*b*, which is an example of a rotation member that covers the outer surface of the magnet roller R0*a*.

Thus, the developer in the developer container V circulates in the direction of arrows Yb while being agitated by the augers R1 and R2.

In FIG. 4B, the stuck-developer transport auger R3 transports the developer stuck between the agitation auger R2 and the development roller R0.

In FIG. 2, a feed port 6, which is an example of a feeding unit, is disposed in a front end portion of the front upper tube 2*a*. In FIGS. 2, 3, and 4A, an outlet port 7, which is an example of an outlet portion, is disposed in a side surface of the front upper tube 2*a*. The outlet port 7 according to the first exemplary embodiment is positioned upstream from the feed port 6 in a developer transport direction to reduce the ratio of the new developer discharged soon after fed from the feed port 6. A developer is fed to the feed port 6 from a toner cartridge, not illustrated.

In FIG. 4B, a trimmer 8, which is an example of a thickness restricting member, is supported at an upper end inside the developer container V. The trimmer 8 restricts the thickness of a developer on the surface of the development roller R0.

In FIG. 2, a gear G0 is mounted on a rear end portion (−X end portion) of a shaft of the development roller R0. Gears G1, G2, and G3 are mounted on rear end portions of the shafts of the augers R1 and R2 and the stuck-developer transport auger R3. The gears G0 and G1 are engaged with each other with an intermediate gear G4 interposed therebetween. The gears G1, G2, and G3 are engaged with one another in order. In a development operation, the rotational force of the gear G0 is sequentially transmitted to the gears G4, G1, G2, and G3. At this time, the development roller R0, the augers R1 and R2, and the stuck-developer transport auger R3 rotate.

In FIGS. 2 and 4A, a discharge connection portion 21 is supported at a portion outside of the outlet port 7. A front end portion of a discharge tube 22, which is an example of a discharging path, is connected to the discharge connection portion 21. A recovery container 23, which is an example of a developer recovery portion, is connected to a rear end portion of the discharge tube 22.

In FIG. 2, a discharge auger R5, which is an example of a discharge transporting member, is disposed in the discharge tube 22.

In FIG. 2, a gear G6 is mounted on a rear end portion of a rotation shaft of the discharge auger R5. The gear G6 is engaged with a gear G7 that is engaged with the gear G2. Thus, when the gear G2 rotates, the discharge auger R5 rotates with the gears G7 and G6 interposed therebetween. When the discharge auger R5 rotates, a remnant developer discharged from the outlet port 7 to the discharge tube 22 through the discharge connection portion 21 is transported to the recovery container 23.

Figure 6:
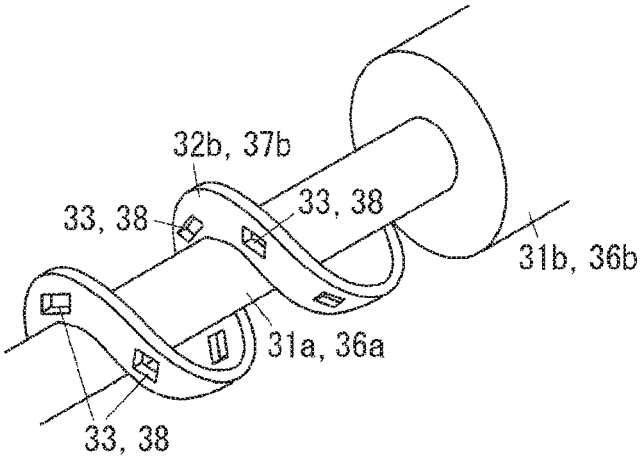
FIG. 6 is a perspective view of a related portion of an end portion of a transporting member according to the first exemplary embodiment.

FIG. 6 is a perspective view of a related portion of an end portion of the transporting member according to the first exemplary embodiment.

As illustrated in FIGS. 3 and 5, in the developing device G according to the first exemplary embodiment, the agitation auger R2 includes an agitating shaft 31, which is an example of a first shaft. The agitating shaft 31 extends through the agitation chamber V2 in the front-rear direction. In FIGS. 3, 5, and 6, the agitating shaft 31 has a small-diameter portion 31*a* at its rear end portion. The small-diameter portion 31*a* has a smaller diameter than a center portion 31*b* of the agitating shaft 31. A boundary portion between the small-diameter portion 31*a* and the center portion 31*b* has a step shape, as illustrated in FIGS. 5 and 6. The outer diameter of the center portion 31*b* is determined in advance through, for example, experiments so as not to cause streaked image defects, or auger marks, extending along an agitating blade 32 (described below) during development.

The agitating shaft 31 supports an agitating blade 32, which is an example of a first transporting portion. The agitating blade 32 helically extends around the agitating shaft 31. The agitating blade 32 includes a forward transport blade 32*a*, which is an example of a forward transporting portion positioned on the center portion 31*b*, and a reverse transport blade 32*b*, which is an example of a reverse transporting portion positioned on the small-diameter portion 31*a*. The reverse transport blade 32*b* is positioned so as to correspond to a rear communication port 4*b*, which is an example of a lift portion. In the first exemplary embodiment, the length of the reverse transport blade 32*b* in the axial direction is determined to be greater than or equal to a distance by which the reverse transport blade 32*b* proceeds in the axial direction in response to one rotation of the agitating shaft 31, that is, greater than or equal to two pitches per pitch.

Figure 7:
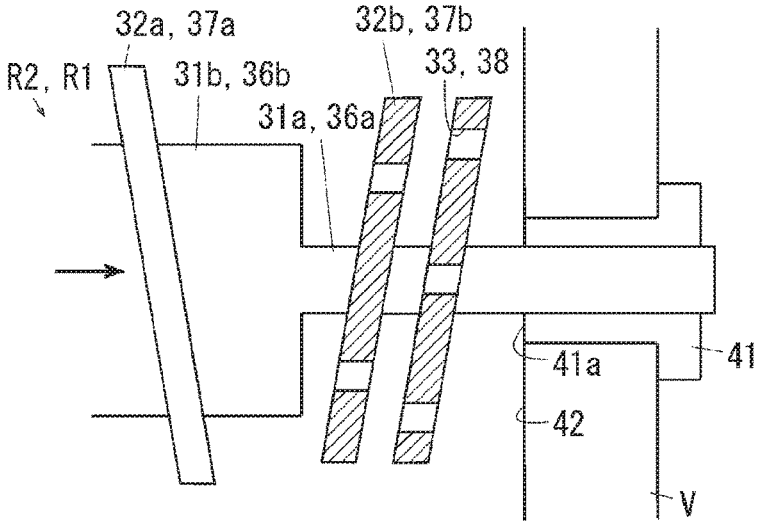
FIG. 7 is a schematic diagram of an end portion of the transporting member according to the first exemplary embodiment.

FIG. 7 is a schematic diagram of an end portion of the transporting member according to the first exemplary embodiment.

In FIGS. 5 to 7, the reverse transport blade 32*b* according to the first exemplary embodiment has multiple air holes 33, which are an example of passage portions. The air holes 33 according to the first exemplary embodiment extend through the reverse transport blade 32*b* in the axial direction. The air holes 33 are spaced apart from one another in the surface of the reverse transport blade 32*b*. The air holes 33 according to the first exemplary embodiment are spaced at, for example, 80° intervals in the circumferential direction of the agitating shaft 31. Thus, when viewed in the axial direction from the rear end of the agitating shaft 31, a first pitched portion and a second pitched portion of the reverse transport blade 32*b* do not positionally coincide to each other in the circumferential direction. As illustrated in FIG. 7, the air holes 33 in the first pitched portion and the second pitched portion of the reverse transport blade 32*b* do not positionally overlap with each other and are displaced from each other.

The feeding auger R1 includes a feed shaft 36 extending in the front-rear direction, which is an example of a first shaft. As in the agitating shaft 31, the feed shaft 36 includes a front-end small-diameter portion 36*a* and a center portion 36*b*. The feed shaft 36 supports a feed blade 37, which is an example of a first transporting portion. As in the agitating blade 32, the feed blade 37 according to the first exemplary embodiment includes a forward transport blade 37*a* and a front-end reverse transport blade 37*b*. The reverse transport blade 37*b* has air holes 38 similar to the air holes 33.

The agitating shaft 31 and the feed shaft 36 are rotatably supported by sliding bearings 41 at front and rear ends. The sliding bearings 41 according to the first exemplary embodiment are cylindrical tubular members and support each shaft 31 or 36 at their inner surfaces. Each sliding bearing 41 according to the first exemplary embodiment is arranged while having its inner end 41*a* aligned with, that is, flush with an inner surface 42 of the developer container V.

Operation of First Exemplary Embodiment

During image formation, in the copying machine U including the developing device G according to the first exemplary embodiment having the above structure, the augers R1 and R2 rotate to agitate and transport the developer in the developer container V. Reverse transport blades 37*b* and 32*b* are respectively disposed at the downstream end portions of the augers R1 and R2 in the axial direction. At the downstream end portions of the augers R1 and R2 in the axial direction, the reverse transport blades 37*b* and 32*b* transport the developer upstream, that is, in a direction away from the sliding bearings 41. Nevertheless, the reverse transport blades 32*b* and 37*b* are not capable of fully preventing the developer from moving toward the sliding bearings 41 or the inner surface 42 of the developer container V. Particularly, the developer is more likely to accumulate at the rear communication port 4*b* at which the developer is lifted than at the front communication port 4*a* at which the developer falls down with the gravity. Thus, the developer is more likely to proceed to the sliding bearing 41.

Figure 8:
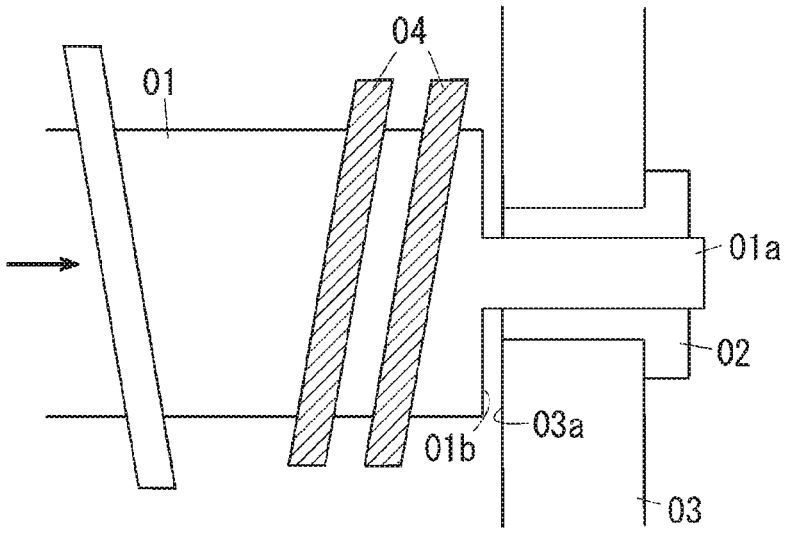
FIG. 8 illustrates a shaft end portion of an existing developing device.

FIG. 8 illustrates a shaft end portion of an existing developing device.

As described above, the shafts 31 and 36 are supposed to have an outer diameter at the center portion large enough to prevent auger marks. Manufacturing, as needed, the sliding bearings 41 that have a thickness corresponding to the thickness of the shafts 31 and 36 increases the manufacturing costs. To avoid this, sliding bearings having a predetermined size are usually used. Each shaft 31 or 36 thus generally has different thicknesses at the end portions, at which it is supported by the sliding bearings 41, and at the center portion. If the developer enters the sliding bearings 41 and hardens there, the developer serves as rotational resistance of the auger R1 or R2. Existing technologies thus have employed a structure, as illustrated in FIG. 8, in which a thick center portion is located closest possible to the corresponding sliding bearing 41, a structure including a sealing agent, as described in Japanese Patent Application Publication No. 2015-194685 (paragraphs [0016] to [0021] and FIGS. 5 and 6), and a structure that facilitates removal of the developer that has entered, as described in Japanese Patent Application Publication No. 2014-235367 (paragraphs [0031] and [0038] and FIG. 3).

With a recent increase of the printing speed, however, the rotation speed of the augers R1 and R2 has also been increasing. The particle diameter of the developer has also been decreasing. These factors have increasingly made it difficult to prevent the developer from entering the sliding bearings using a sealing agent or other materials. In the existing structure illustrated in FIG. 8, the rotation of the auger has caused a problem of heat generation as a result of friction between a rear end portion 01*a* of a shaft 01 and a sliding bearing 02 or rubbing of the developer between a center portion 01*b* of the shaft 01 and an inner surface 03*a* of a developer container 03. An existing structure does not include a heat dissipation mechanism at the end in the axial direction. The existing structure instead includes the developer container 03 having a bottom surface, side surfaces, and an upper surface that surround a transport blade 04 and is thus more likely to confine heat. The developer is more likely to have its quality changed or deteriorate with heat and adhere to the shaft 01 or the transport blade 04 or harden into a mass. If the shaft 01 has the developer attached thereto or bears a sliding load caused by rubbing of the developer between the center portion 01*b* of the shaft 01 and the inner surface 03*a* of the developer container 03, the shaft 01 bears a rotation load and, in the worst-case scenario, the shaft 01 may be bent at the bearing 02. The structures described in Japanese Patent Application Publication Nos. 2014-235367 (paragraphs [0031] and [0038] and FIG. 3) and 2015-194685 (paragraphs [0016] to [0021] and FIGS. 5 and 6) also have the similar problem to occur between the communication space or the sealing agent and the wall surface of the developer container.

In contrast to these structures, the developing device G according to the first exemplary embodiment includes the reverse transport blades 32*b* and 37*b* having air holes 33 and 38 at the end portion in the axial direction. The developing device G is thus less likely to confine heat at the end portions of the augers R1 and R2 than the existing structures that does not have the air holes 33 and 38. The developing device G thus prevents the developer from adhering to the bearings during rotation of the augers R1 and R2 due to a rise in temperature at the shaft end portions. Here, using expensive ball bearings is capable of preventing heat generation resulting from the friction regardless of how fast the augers R1 and R2 would rotate. The use of the ball bearings, however, increases manufacturing costs. The first exemplary embodiment, in contrast, includes the sliding bearings 41, which prevent a cost increase compared to the use of the ball bearings.

In the first exemplary embodiment, each auger R1 or R2 has a small-diameter portion 36*a* or 31*a* at its end in the axial direction. The small-diameter portion 31*a* or 36*a* extends to a position a predetermined distance inward from the inner end 41*a* of the sliding bearing 41. Thus, the distance between the inner end 41*a* of the sliding bearing 41 and the stepped portion, which is located between the small-diameter portion 31*a* or 36*a* and the center portion 31*b* or 36*b*, is longer than that in the existing structure. The structure according to the first exemplary embodiment thus reduces the amount of the developer rubbed between the center portion 31*b* or 36*b* and the inner end 41*a* of the sliding bearing 41 or the inner surface of the developer container V compared to the existing structure. The structure according to the first exemplary embodiment thus reduces adhesion of the developer resulting from the quality change or deterioration or the sliding load on the augers R1 and R2.

In the first exemplary embodiment, the air holes 33 and 38 are formed at downstream end portions of the augers R2 and R1 in the developer transportation direction Yb. In other words, the developer is less likely to proceed to the upstream end portions than to the downstream end portions and less likely to cause a problem at the upstream end portions. Compared to the case where the air holes 33 and 38 are also formed at the portions at which the developer is less likely to cause a problem, the processing or manufacturing costs are reduced in this structure.

In the first exemplary embodiment, the air holes 33 and 38 are through holes. This structure reduces heat confinement while the reverse transport blades 32*b* and 37*b* retain the function of reversely transporting the developer.

In the first exemplary embodiment, the air holes 33 and 38 are located at different angular positions in the first pitched portion and the second pitched portion. If the air holes are located at the same angular positions, after the developer that has transported thereto from the upstream side passes through the air hole 33 or 38 in the second pitched portion, the developer is more likely to directly pass through the air hole 33 or 38 in the first pitched portion. This structure disadvantageously allows the developer to easily access the sliding bearing 41. In the structure according to the first exemplary embodiment, on the other hand, the air holes 33 and 38 in the first pitched portion and the second pitched portion are located at different angular positions. The developer that has passed through the air hole 33 or 38 in the second pitched portion touches the surface of the reverse transport blade 32*b* or 37*b* at the first pitched portion. The developer is thus reversely transported by the reverse transport blade 32*b* or 37*b*. The structure according to the first exemplary embodiment thus reduces the amount of developer entering the sliding bearing 41 compared to the structure in which the air holes are located at the same angular position.

Second Exemplary Embodiment

A second exemplary embodiment of the present invention is described now. In the description of the second exemplary embodiment, components corresponding to the components according to the first exemplary embodiment are denoted with the same reference sings and are not described in detail.

The second exemplary embodiment differs from the first exemplary embodiment in the following points but is the same as the first exemplary embodiment in the other points.

Figure 9:
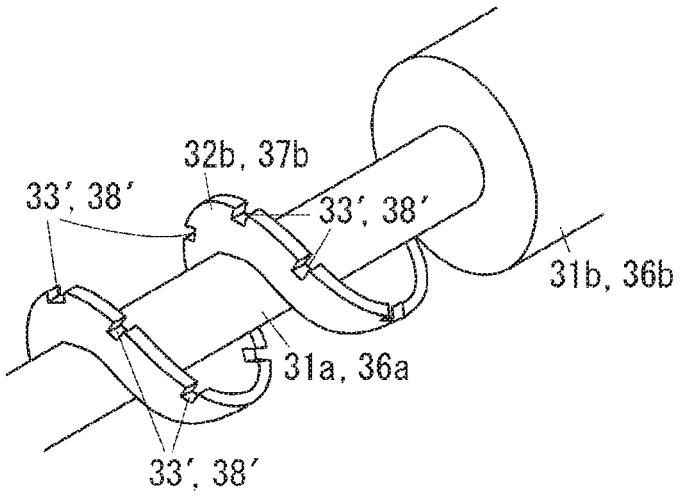
FIG. 9 illustrates a passage portion according to a second exemplary embodiment and corresponds to FIG. 6 for the first exemplary embodiment.

FIG. 9 illustrates a passage portion according to the second exemplary embodiment and corresponds to FIG. 6 for the first exemplary embodiment.

In FIG. 9, a developing device G according to the second exemplary embodiment includes cuts 33' and 38', formed by cutting the outer periphery of the reverse transport blades 32*b* and 37*b* as an example of passage portions, in place of the air holes 33 and 38, extending through the reverse transport blades 32*b* and 37*b* according to the first exemplary embodiment.

Operation of Second Exemplary Embodiment

As in the first exemplary embodiment, the developing device G according to the second exemplary embodiment having the above-described structure is capable of dissipating heat through the cuts 33' and 38'. The structure according to the second exemplary embodiment thus reduces heat confined at the end portions of the augers R1 and R2 in the axial direction and adhesion of the developer.

Third Exemplary Embodiment

A third exemplary embodiment of the present invention is described now. In the description of the third exemplary embodiment, components corresponding to the components according to the first exemplary embodiment are denoted with the same reference sings and are not described in detail.

The third exemplary embodiment differs from the first exemplary embodiment in the following points but is the same as the first exemplary embodiment in the other points.

Figure 10:
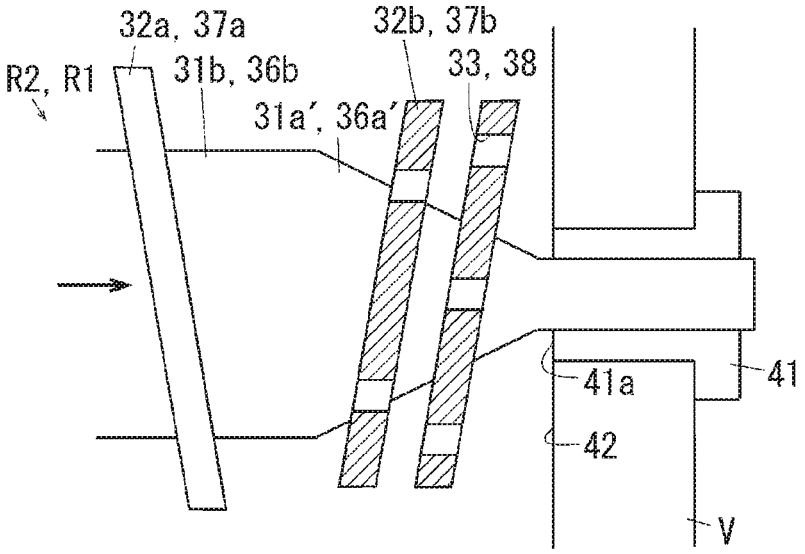
FIG. 10 illustrates a small-diameter portion according to a third exemplary embodiment and corresponds to FIG. 7 for the first exemplary embodiment.

FIG. 10 illustrates a small-diameter portion according to the third exemplary embodiment and corresponds to FIG. 7 for the first exemplary embodiment.

In FIG. 10, in place of the step-shaped small-diameter portion 31*a* or 36*a* at the boundary portion between itself and the center portion 31*b* or 36*b* according to the first exemplary embodiment, the developing device G according to the third exemplary embodiment includes a small-diameter portion 31*a*' or 36*a*', which has its diameter continuously decreasing toward the outer end in the axial direction.

Operation of Third Exemplary Embodiment

As in the first exemplary embodiment, the developing device G according to the third exemplary embodiment having the above-described structure reduces the developer rubbed at the end portions of the augers R1 and R2. Thus, as in the first exemplary embodiment, the structure according to the third exemplary embodiment reduces heat generation, adhesion of the developer, or an increase of sliding load.

Modified Examples

The exemplary embodiments of the present invention have been described in detail thus far. The present invention is, however, not limited to the above exemplary embodiments and may be modified variously within the scope of the gist of the present invention described in the scope of claims. Modified examples H01 to H012 of the present invention are described, below.

H01: The above exemplary embodiments have described, by way of example, the copying machine U as an example of an image forming apparatus. The image forming apparatus is not limited to this and may be, for example, a printer, a FAX, or a multifunctional machine having at least two or all of these functions.

H02: The above exemplary embodiments have described, by way of example, the copying machine U that uses a single color developer. The image forming apparatus is not limited to this and may a dual-color or multi-color image forming apparatus.

H03: The above exemplary embodiments have described, by way of example, the augers R1 and R2 respectively including the reverse transport blades 32*b* and 37*b*. The present invention is not limited to this. The structure that does not include the reverse transport blades 32*b* and 37*b* may include the air holes 33, 33', 38, or 38' or include the small-diameter portion 31*a*, 36*a*, 31*a*', or 36*a*'. The reverse transport blades 32*b* and 37*b* extend a length greater than or equal to two pitches but may extend less than two pitches.

H04: The above exemplary embodiments have described, by way of example, a structure in which the air holes 33, 33', 38, and 38' and the small-diameter portions 31*a*, 36*a*, 31*a*', and 36*a*' are formed at the downstream ends of the augers R1 and R2, but this is not the only possible structure. The air holes and the small-diameter portions may also be formed at the upstream ends of the augers R1 and R2.

H05: The above exemplary embodiments have described, by way of example, a structure in which the feeding auger R1 and the agitation auger R2 have the air holes 33, 33', 38, and 38' and the small-diameter portions 31*a*, 36*a*, 31*a*', and 36*a*', but this is not the only possible structure. For example, the air holes may be formed, for example, only in the region corresponding to the rear communication port 4*b*.

H06: The above exemplary embodiments have described, by way of example, the developing device G including the feeding auger R1 and the agitation auger R2 arranged parallel to each other on the upper and lower sides, but this is not the only possible structure. The present invention is also applicable to a developing device in which the feeding auger R1 and the agitation auger R2 are arranged side by side horizontally or obliquely.

H07: The above exemplary embodiments have described, by way of example, the air holes 33, 33', 38, and 38' spaced from one another in the circumferential direction and formed at different angular positions in the first pitched portion and the second pitched portion, but this is not the only possible structure. The number, the position, the size, the shape (for example, circular or triangular holes or V-shaped cuts), or other properties of the air holes may be changed in accordance with the design or specifications.

H08: In the above exemplary embodiments, the small-diameter portions 31*a*, 36*a*, 31*a*', and 36*a*' having a stepped or tapering shape have been described by way of example, but this is not the only possible structure. For example, instead of two steps formed by the small-diameter portion and the center portion, the shaft may have three or more steps. Alternatively, instead of a small-diameter portion whose contour linearly tapers toward the outer end, as illustrated in FIG. 10, the contour may tapers in any other forms including a parabola form and a curve of the second order.

H09: The exemplary embodiments have described the developing device G as a developer container by way of example, but this is not the only possible structure. The developer container may have other structures that hold a developer and a transporting member. For example, the present invention is also applicable to a toner cartridge that holds a developer to be fed to a developing device, a feeding device that transports the developer in the toner cartridge toward the developing device, a developer discharging device that transports the developer discharged from the developing device, and a recovery container that holds the developer transported from the developer discharging device. The present invention is also applicable to a developer transporting member disposed in a drum cleaner CLp.

H010: In the above exemplary embodiments, the low-cost sliding bearings are used as bearing members. Ball bearings or other bearings may be used, instead.

H011: In the above exemplary embodiments, the helical blades 32 and 37 are described as examples of transporting members, but this is not the only possible structure. Instead, semicircular transport blades obliquely supported on the shaft or other blades may also be used.

H012: In the above exemplary embodiments, the inner end 41*a* of each sliding bearing 41 is arranged flush with the inner surface 42 of the developer container V, but this is not the only possible structure. The inner end 41*a* may be arranged flush with or inward from the inner surface 42 of the developer container V.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container comprising:

a container that holds a developer;

a transporting member that includes a shaft, rotatably supported by the container, and a transporting portion that is supported by the shaft and that transports the developer in the container when the shaft rotates, the transport portion comprising blades extending helically along the shaft; and a plurality of passage portions formed in the blades to allow air to pass therethrough in an axial direction of the shaft, the passage portions disposed on adjacent blades are offset such that the passage portions in adjacent blades do not overlap when viewed in an axial direction of the shaft, wherein the adjacent blades have passage portions disposed such that a passage portion on one of the adjacent blades is visible to another passage portion on another of the adjacent blades when viewed from the another passage portion.

2. The developer container according to claim 1, wherein the passage portion is formed at a downstream end portion in a developer transportation direction in which the transporting member transports the developer.

3. The developer container according to claim 2, wherein the transporting portion includes a forward transporting portion, which transports the developer in the developer transportation direction when the shaft rotates, and a reverse transporting portion, which is disposed at a portion near a downstream end in the developer transportation direction and which transports the developer in a direction opposite to the transportation direction in which the forward transporting portion transports the developer, and wherein the passage portion is formed in the reverse transporting portion.

4. The developer container according to claim 1, further comprising a lift portion, which is disposed at a downstream end portion of the transporting member in the developer transportation direction and which lifts the developer, wherein the passage portion is formed at the downstream end portion of the transporting member.

5. The developer container according to claim 4, wherein the transporting member includes a first transporting member, which transports a developer in a predetermined first developer transportation direction, and a second transporting member, which is disposed under the first transporting member in a gravitational direction and which transports the developer in a direction opposite to the first developer transportation direction, wherein the lift portion connects an upstream end portion of the first transporting member to a downstream end portion of the second transporting member, and wherein the passage portion is formed at the downstream end portion of the second transporting member.

6. The developer container according to claim 1, wherein the passage portion extends through the transporting portion in an axial direction.

7. The developer container according to claim 1, wherein the passage portion is a cut in a radial outer circumference of the transporting portion.

8. The developer container according to claim 1, further comprising:

a bearing member that supports the shaft so that the shaft is rotatable and that has an inner end surface arranged flush with or inward from an inner surface of the container; and the shaft having a small-diameter portion disposed inward from the inner end surface of the bearing member and at an end portion of the shaft in an axial direction, the small-diameter portion having a smaller outer diameter than an axial center portion of the shaft, the transporting portion being disposed on an outer periphery of the small-diameter portion.

9. The developer container according to claim 8, wherein the small-diameter portion has a diameter that tapers toward an outer end in the axial direction.

10. An image forming apparatus, comprising:

an image carrier;

a latent-image forming device that forms a latent image on a surface of the image carrier;

a developing device including the developer container according to claim 1 that develops the latent image on the surface of the image carrier into a visible image;

a transfer device that transfers the visible image on the surface of the image carrier to a medium; and a fixing device that fixes the visible image on the surface of the medium to the medium.

* * * * *